US006098542A

United States Patent [19]

Dufour

[11] Patent Number: 6,098,542

[45] Date of Patent: Aug. 8, 2000

[54] METHOD AND DEVICE FOR FORCE LOADING A RUBBER BLANKET ROLLER IN A PRINTING PRESS

[75] Inventor: Charles Henry Dufour, Durham, N.H.

[73] Assignee: Heidelberger Druckmaschinen AG, Heidelberg, Germany

[21] Appl. No.: 09/251,985

[22] Filed: Feb. 17, 1999

[51] Int. Cl.[7] ..... B41F 31/00; B41F 7/02; B41F 13/24

[52] U.S. Cl. ..... 101/352.05; 101/352.01; 101/217; 101/218; 101/247

[58] Field of Search ..... 101/247, 352.01, 101/352.02, 352.04, 352.05, 217, 218

[56] References Cited

U.S. PATENT DOCUMENTS

| | | | |
|---|---|---|---|
| 3,672,298 | 6/1972 | Reif | 101/349 |
| 4,041,864 | 8/1977 | Dahlgren et al. | 101/350 |
| 4,122,772 | 10/1978 | Dahlgren | 101/218 |
| 4,127,067 | 11/1978 | Dahlgren et al. | 101/426 |
| 4,290,360 | 9/1981 | Fischer | 101/148 |
| 4,354,431 | 10/1982 | Fischer | 101/247 |
| 4,520,729 | 6/1985 | Fischer | 101/349 |
| 5,134,934 | 8/1992 | Knauer et al. | 101/143 |
| 5,191,836 | 3/1993 | Weis | 101/219 |
| 5,272,975 | 12/1993 | Dettinger et al. | 101/218 |
| 5,275,099 | 1/1994 | Kawagoe | 101/216 |
| 5,311,817 | 5/1994 | Funada | 101/177 |
| 5,339,736 | 8/1994 | Dorsam et al. | 101/352 |
| 5,448,949 | 9/1995 | Bucher | 101/216 |
| 5,460,088 | 10/1995 | Heiler et al. | 101/142 |

*Primary Examiner*—Kimberly Asher
*Attorney, Agent, or Firm*—Herbert L. Lerner; Laurence A. Greenberg; Werner H. Stemer

[57] ABSTRACT

A rubber roller in a printing press inker or dampener is force loaded against its adjacent rollers with hydraulic cylinders. The bearings of the adjacent rollers are fixed in the machine frame, while the position setting sockets of the rubber roller are supported on the hydraulic cylinders. The rubber roller can be thrown on and off by actuating the hydraulic cylinders and the loading force can be adjusted by the hydraulic pressure in the hydraulic cylinders.

11 Claims, 1 Drawing Sheet

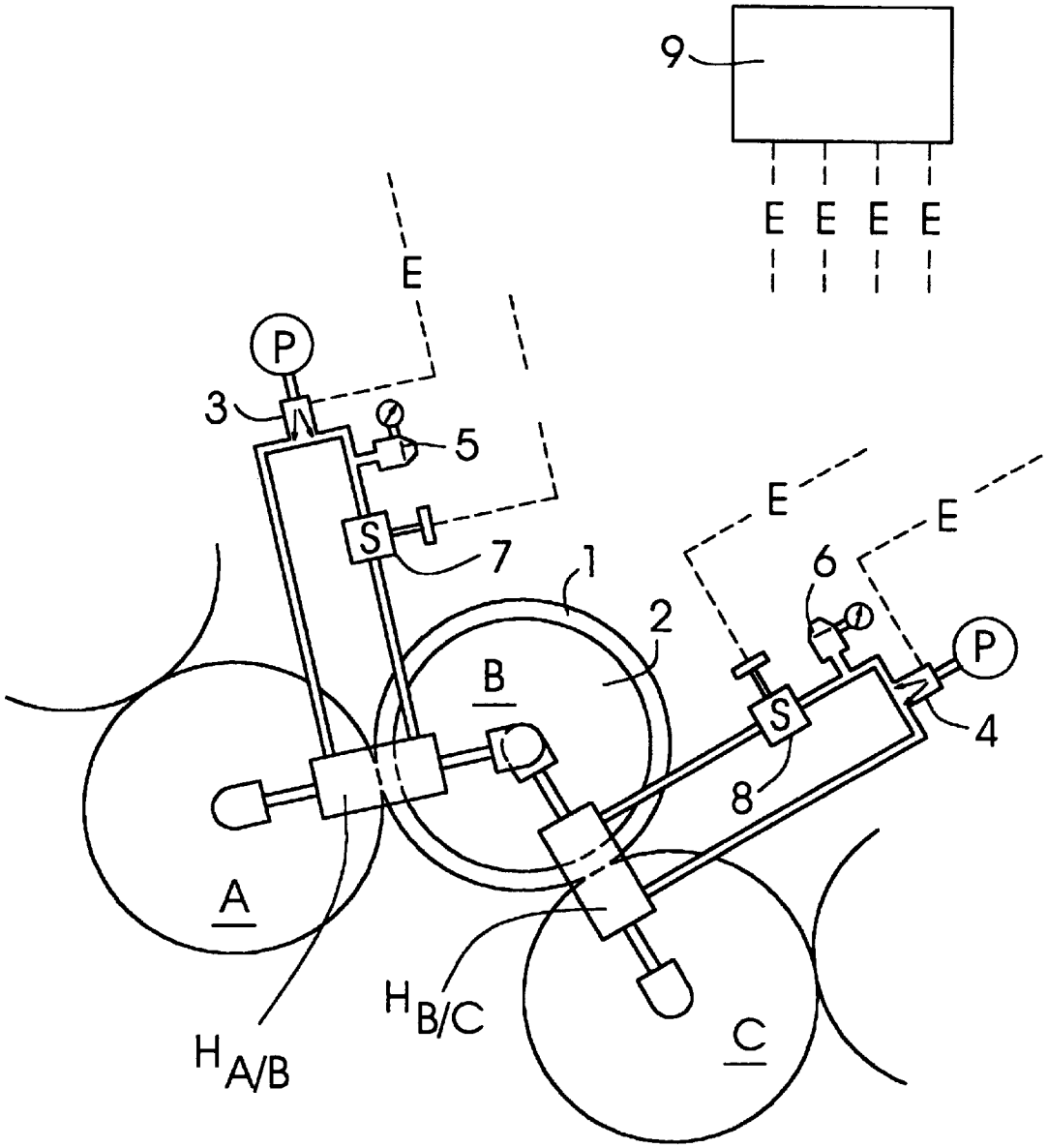
9
E
E
E
E
E
E
E
P
3
5
S
7
1
2
6
P
4
S
8
B
A
C
$H_{A/B}$
$H_{B/C}$

METHOD AND DEVICE FOR FORCE LOADING A RUBBER BLANKET ROLLER IN A PRINTING PRESS

BACKGROUND OF THE INVENTION

Field of the Invention

The invention lies in the printing field. More particularly, the invention relates to a method and a device for force loading a rubber roller in the inker and dampener of a printing press.

Rubber blanket rollers are used in inkers for ink transfer from the take-up roller to the impression cylinder and in dampeners for the transfer of dampening solution from one cylinder to another. The rubber roller must thereby be biased, i.e. force-loaded against the other rollers. In the printing-off position of the printing unit or for cleaning the blanket it is advantageous to throw the blanket roller off the other rollers. In production use, furthermore, the rubber covering may swell with increased heat and due to other dynamic effects and the loading pressure of the rubber blanket on the counter-rollers thus changes during operation.

Many prior art systems do not allow for a dynamic adjustment during a production run. The rubber rollers are thereby force-loaded by adjusting the respective inker and dampener position setting sockets during the production setup. This leads to a difficult and time consuming setup procedure. Also, the set adjustment does not allow compensation for temperature and roller swelling.

One system has been proposed wherein the rubber rollers are adjusted by way of motors. The system with the motorized adjustment of the rubber rollers is complicated and requires a high degree of maintenance. Furthermore print quality suffers with the inadequate compensation of temperature effects.

SUMMARY OF THE INVENTION

It is accordingly an object of the invention to provide a method and a device for force loading a rubber roller in the inker and dampener of a printing press, which overcomes the above-mentioned disadvantages of the heretofore-known devices and methods of this general type and which assures that the rubber roller is accurately and constantly force loaded against the respective other rollers.

With the foregoing and other objects in view there is provided, in accordance with the invention, a device for force-loading a rubber roller in a printing press inker or dampener. The force-loading device comprises:

a hydraulic actuator connected between the rubber roller and the at least one adjacent roller for force loading the rubber roller to the at least one adjacent roller, the hydraulic actuator communicating with a hydraulic pressure source.

In accordance with an added feature of the invention, the hydraulic actuator is a double-piston hydraulic cylinder.

In accordance with again an added feature of the invention, an actuator valve is connected between the hydraulic actuator and the hydraulic pressure source.

In accordance with an additional feature of the invention, the actuator valve is an electrically controlled four-way hydraulic valve. There may be provided an electrical signal line connecting the hydraulic valve to a control panel. The control panel may be a separate rubber roller adjustment panel or the setup adjustment may be integrated in the main press operator control system. It is further understood that the pressure control or regulation may be processor controlled.

In accordance with another feature of the invention, a shutoff valve is connected in a hydraulic fluid loop connecting the hydraulic actuator to the hydraulic pressure source.

In accordance with again another feature of the invention, a pressure regulator is connected in the hydraulic fluid loop connecting the hydraulic actuator to the hydraulic pressure source.

In accordance with a further feature of the invention, the rubber roller is an ink transfer roller in an inker of the printing press and the at least one adjacent roller is an ink vibrator.

In accordance with again a further feature of the invention, the at least one adjacent roller is rotatably disposed about an axis fixedly supported in a machine frame of the printing press, and the rubber roller is rotatably disposed about an axis movably supported relative to the machine frame by the intermediary of the hydraulic actuator.

With the above and other objects in view there is also provided, in accordance with the invention, a method of force-loading a rubber roller to an adjacent roller in a printing press. The method comprises the steps of pressurizing a hydraulic actuator connected between a rubber roller and an adjacent roller, whereby the rubber roller is supported against the adjacent roller by intermediary of the hydraulic actuator, and adjusting a pressure in the hydraulic actuator for adjusting a force loading of the rubber roller to the adjacent roller.

In accordance with a concomitant feature of the invention, the force loading is adjusted in a "throw on" position of the rubber roller, and the rubber roller may be selectively moved to a "throw off" position in which the rubber roller is disengaged and spaced apart from the adjacent roller.

Temperature changes and dynamic effects are automatically compensated for in the novel system, because the pressure of the pressurized system is directly proportional to the force loading of the rubber roller. The invention results in lower maintenance, it compensates for temperature effects, and leads to better print quality, as compared to the prior art systems.

Other features which are considered as characteristic for the invention are set forth in the appended claims.

Although the invention is illustrated and described herein as embodied in a method and a device for force loading a rubber roller in the inker and dampener of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The sole figure is a diagrammatic elevational view of a rubber roller force-loaded against two adjacent rollers and a relevant hydraulic pressure system.

DESCRIPTION OF THE PREFERRED EMBODIMENTS

Referring now to the sole figure of the drawing in detail, there is seen a rubber roller B which is force loaded against a roller A and a roller C of a rotary printing press. The rubber roller B carries a rubber blanket or rubber covering 1 on its cylinder core. The roller C may be, for instance, a nylon-covered ink vibrator or the like. The rollers A, B, and C rotate about mutually parallel axes.

By way of example, the rollers may be disposed in a web-fed rotary printing press. In particular, if the press is a double width newspaper press, then the rubber roller B is loaded against the rollers A and/or C with a maximum rubber roller loading of 1.8 kg/cm. A 160 cm long rubber roller stripe would require 180 kg load. That loading is provided, in the invention, with hydraulic actuators in the form of hydraulic cylinders $H_{A/B}$ and $H_{B/C}$ which carry the respective roller axles at their respective piston legs. In the exemplary system, each of the hydraulic cylinders would supply 90 kg load.

A desirable operating pressure for the hydraulic cylinders is 70 kg/cm$^2$ (≈1000 psi), which renders cylinder piston friction negligible. A hydraulic cylinder with a 1.3 cm (≈0.5") bore supplies the necessary 90 kg load with 70 kg/cm$^2$ pressure (force equals pressure times area).

Each of the hydraulic cylinders $H_{A/B}$ and $H_{B/C}$ is controlled by a four-way valve 3, 4. The valves may be marked "throw off" and "throw on," and they can be independently set to cause the rubber roller B to be force loaded to the ink vibrator roller C, for example, while the roller B is thrown off from the roller A. Typically, however, the rubber roller B will be thrown on or thrown off from both rollers at the same time. The valves 3 and 4 are electrically actuated through electrical signal lines E. The signal lines E may be connected to a subcontrol panel 9 set up specifically for the rubber roller adjustment, or they may be connected to the printing unit and/or the central press control. Pressure is supplied through the valves 3 and 4 from a hydraulic pressure source P.

A pressure regulator 5, 6 is connected into the hydraulic loop of each of the hydraulic cylinders $H_{A/B}$ and $H_{B/C}$. The pressure regulator 5 regulates the load between the rollers A and B, while the pressure regulator 6 regulates the load between the rollers B and C.

A shutoff valve 7, 8 is connected into each of the hydraulic loops as well. The shutoff valves 7 and 8 lock the position between the rubber roller B and its adjacent rollers after the appropriate loads have been set. The position relationships are locked because the hydraulic fluid is non-compressible. The shutoff valve may be opened periodically during operation so allow for position readjustment and pressure automatic reset.

It can be seen that the system automatically compensates for growth of the rubber roller due to temperature changes, swelling, and other dynamic effects. It is also noted that, if vibratory effects and conditions are negligible, the shutoff valves 7 and 8 may be permanently left in their open positions.

I claim:

1. In a printing press having a rubber roller and an adjacent roller, a device for force-loading the rubber roller to the adjacent roller, comprising:

a hydraulic actuator radially connected between the rubber roller and the adjacent roller for force loading the rubber roller to the adjacent roller; and a hydraulic loop allowing said hydraulic actuator to communicate with a hydraulic pressure source, said hydraulic loop including a shutoff valve for locking a position of the rubber roller with respect to the adjacent roller.

2. The force-loading device according to claim 1, wherein said hydraulic actuator is a double-piston hydraulic cylinder.

3. The force-loading device according to claim 1, which further comprises an actuator valve connected between said hydraulic actuator and said hydraulic pressure source.

4. The force-loading device according to claim 3, wherein said actuator valve is an electrically controlled four-way hydraulic valve.

5. The force-loading device according to claim 4, which further comprises an electrical signal line connecting said hydraulic valve to a control panel.

6. The force-loading device according to claim 1, which further comprises a pressure regulator connected in a hydraulic fluid loop connecting said hydraulic actuator to said hydraulic pressure source.

7. The force-loading device according to claim 1, wherein the rubber roller is an ink transfer roller in an inker of the printing press and the at least one adjacent roller is an ink vibrator.

8. The force-loading device according to claim 1, wherein the adjacent roller is rotatably disposed about an axis fixedly supported in a machine frame of the printing press, and the rubber roller is rotatably disposed about an axis movably supported relative to the machine frame by the intermediary of said hydraulic actuator.

9. A method of force-loading a rubber roller to an adjacent roller in a printing press, which comprises:

radially connecting a hydraulic actuator between a rubber roller and an adjacent roller such that the rubber roller is supported against the adjacent roller;

providing a hydraulic loop to allow the hydraulic actuator to communicate with a hydraulic pressure source;

providing the hydraulic loop with a shutoff valve for locking a position of the rubber roller with respect to the adjacent roller; and adjusting a pressure in the hydraulic actuator to adjust a force loading of the rubber roller to the adjacent roller.

10. The method according to claim 9, which comprises adjusting the force loading in a "throw on" position of the rubber roller, and selectively moving the rubber roller to a "throw off" position in which the rubber roller is spaced apart from the adjacent roller.

11. The method according to claim 9, which comprises:

closing the shutoff valve to lock the position of the rubber roller with respect to the adjacent roller; and opening the shutoff valve during operation of a printing press so that the position of the rubber roller with respect to the adjacent roller is readjusted.

* * * * *